US006328437B1

(12) United States Patent
Mihara et al.

(10) Patent No.: US 6,328,437 B1
(45) **Date of Patent: *Dec. 11, 2001**

(54) LIQUID INJECTION METHOD

(75) Inventors: Hiroaki Mihara, Musashino (JP); Toshiaki Sasaki, Irvine, CA (US); Hidehisa Matsumoto, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/927,402

(22) Filed: Sep. 10, 1997

(30) Foreign Application Priority Data

| | | |
|---|---|---|
| Sep. 11, 1996 | (JP) | 8-240440 |
| Oct. 16, 1996 | (JP) | 8-273529 |
| Jul. 25, 1997 | (JP) | 9-200126 |

(51) Int. Cl.[7] ..... B41J 2/175
(52) U.S. Cl. ..... 347/86; 347/85; 347/88
(58) Field of Search ..... 347/84, 85, 86, 347/87, 88, 89; 400/124

(56) References Cited

U.S. PATENT DOCUMENTS

| | | | |
|---|---|---|---|
| 4,509,062 | 4/1985 | Low et al. | 347/87 |
| 4,553,865 * | 11/1985 | Ikeda et al. | 400/124 |
| 5,400,066 | 3/1995 | Matsumoto et al. | 347/86 |
| 5,435,452 | 7/1995 | Nishigami et al. | 215/12.1 |
| 5,440,333 | 8/1995 | Sykora et al. | 347/87 |
| 5,500,665 | 3/1996 | Ujita et al. | 347/86 |

FOREIGN PATENT DOCUMENTS

| | | | |
|---|---|---|---|
| 0 738 605 | 10/1996 | (EP) | B41J/2/175 |
| 0 791 465 | 8/1997 | (EP) | B41J/2/175 |
| 56067269 | 6/1981 | (JP) . | |
| 63-021427 | 1/1988 | (JP) . | |
| 4-267727 | 9/1992 | (JP) . | |
| 06226993 | 8/1994 | (JP) . | |
| 6-226993 | 8/1994 | (JP) . | |
| 82/04242 | 12/1982 | (WO) | B67D/1/04 |

* cited by examiner

*Primary Examiner*—N. Le
*Assistant Examiner*—Anh T. N. Vo
(74) *Attorney, Agent, or Firm*—Fitzpatrick, Cella, Harper & Scinto

(57) ABSTRACT

A liquid injection method for a liquid container for an ink jet recording, the container including a flexible liquid containing portion for containing liquid in substantially hermetically sealed state, a casing, having an inside configuration equivalent or similar to an outer configuration of the liquid containing portion, for separably covering the liquid containing portion, a liquid discharging portion for permitting the liquid to be discharged to outside, the method includes supplying the liquid having a temperature higher than a normal temperature into the liquid containing portion; substantially hermetically sealing the liquid discharging portion with a liquid discharge permission member for permitting the liquid to discharge in use.

9 Claims, 13 Drawing Sheets

FIG. 8(a)
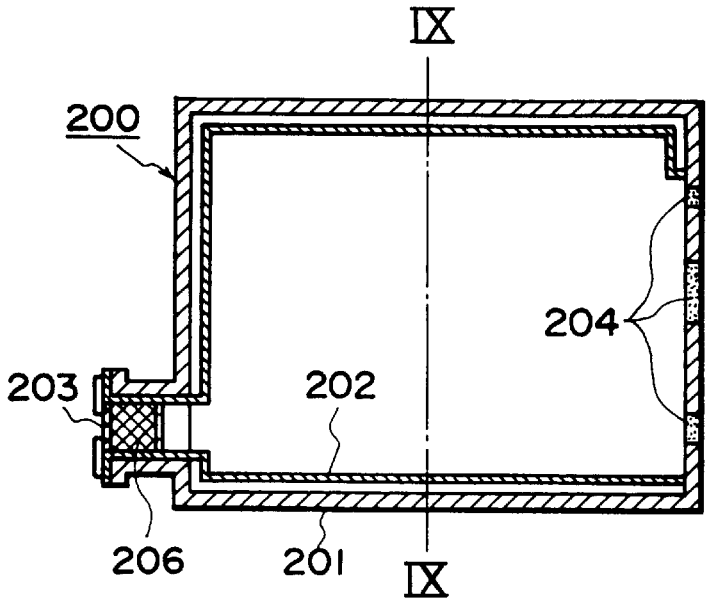
FIG. 8(b)
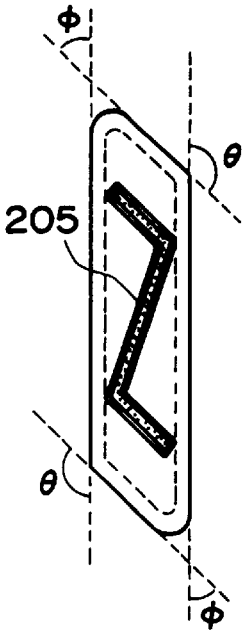
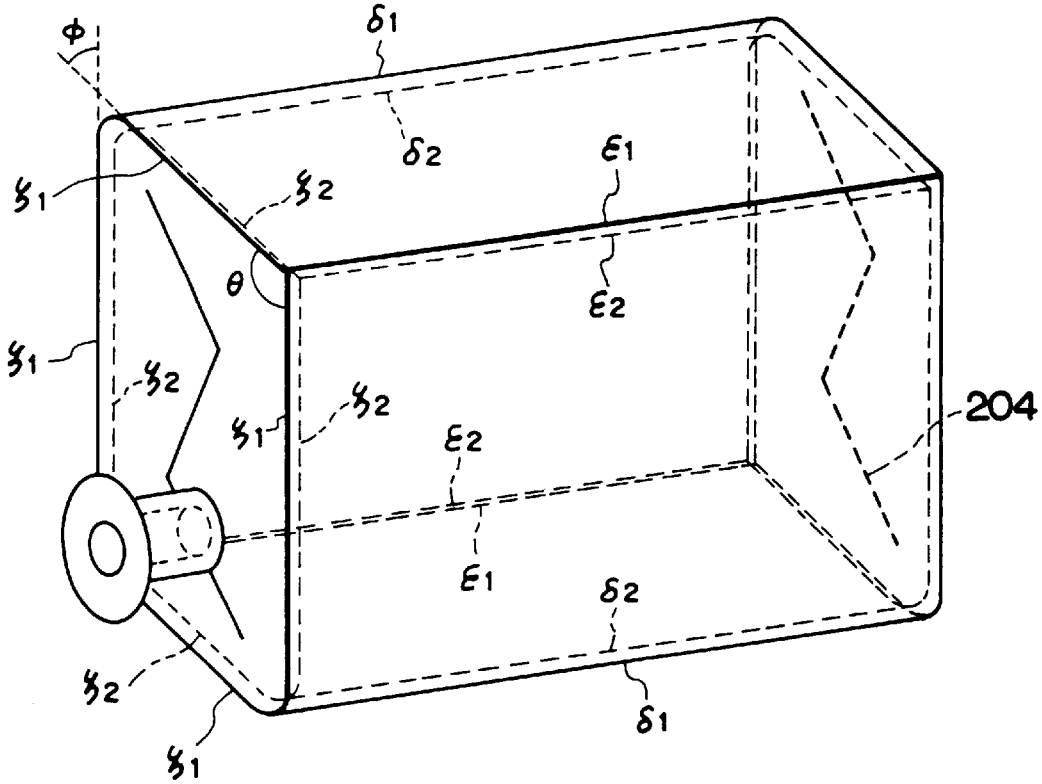
FIG. 8(c)

LIQUID INJECTION METHOD

FIELD OF THE INVENTION AND RELATED ART

The present invention relates to a liquid injection method for a liquid container usable in an ink jet recording field, and more particularly to a liquid injection method for a liquid container having a flexible liquid containing portion capable of forming a sealed space.

As for a liquid accommodating container for accommodating ink or processing liquid for recording in the ink jet recording field, which will hereinafter be called liquid, a structure having a casing and a bladder-like liquid containing portion therein, is known. In a recording device using such a liquid accommodating container, the liquid is usually fed to a recording means through a supply tube from a liquid accommodating container, and the liquid is ejected stably from recording means by providing a static head difference between the recording means and the liquid accommodating container.

With such a recording device, the static head difference is required to be provided between the recording means and the liquid accommodating container, and therefore, it is thought difficult to downsize the recording device. To obviate this problem, an ink jet cartridge is known wherein an ejection head as the recording means and the liquid accommodating container (ink container) can be made integral. In such a case, a mechanism which produces a back pressure against the ink flow toward the recording means is required in place of the static head difference, in order to stably retain the ink and therefore to prevent the ink leakage from the ejection portion such as a nozzle of the recording means. The back pressure is called "negative pressure", since it provides negative pressure relative to the ambient pressure at the ejection outlet portion. The ink jet cartridge is further classified into a type wherein the recording means and the liquid accommodating container are always integral and a type wherein the recording means and the liquid accommodating container are separate, and are separable from the recording device, and they are integrated upon use thereof.

As for a liquid accommodating container used with such an ink jet cartridge, a type is known wherein a bladder-like ink accommodating portion (liquid containing portion) is provided with a spring to produce force against the inward deformation of the bladder due to the consumption of the ink so as to provide the negative pressure (Japanese Laid-open Patent Application No. SHO-56-67269, Japanese Laid-open Patent Application No. HEI-6-226993, for example). U.S. Pat. No. 4,509,062 discloses an ink accommodation portion of rubber having a conical configuration with a rounded top having a smaller thickness than the other portion. The round thinner portion of the circular cone portion provides a portion which displaces and deforms earlier than the other portion. They are quite satisfactory.

However, further development is desired.

More particularly, a larger amount of the ink is desired to be contained in the same volume of the container.

SUMMARY OF THE INVENTION

Accordingly, it is a principal object of the present invention to provide a liquid injection method with high accommodation efficiency without ink leakage against ambient condition change, for a liquid accommodating container capable of supplying liquid out with stabilized negative pressure.

It is another object of the present invention to provide a liquid container manufacturing method and a liquid injection method with high accommodation efficiency without ink leakage against ambient condition change, for a liquid accommodating container having a flexible liquid containing portion which supplies the liquid out using static head difference, and to provide an ink container using the same.

It is a further object of the present invention to provide a container made of simple parts.

According to an aspect of the present invention, there is provided a liquid injection method for a liquid container for an ink jet recording, the container including a flexible liquid containing portion for containing liquid in substantially hermetically sealed state, a casing, having an inside configuration equivalent or similar to an outer configuration of the liquid containing portion, for separably covering the liquid containing portion, a liquid discharging portion for permitting the liquid to be discharged to outside, the method comprising the steps of: supplying the liquid having a temperature higher than a normal temperature into the liquid containing portion; substantially hermetically sealing the liquid discharging portion with a liquid discharge permission member for permitting the liquid to discharge in use.

According to the aspect of the present invention, the accommodation efficiency is increased, thus increasing the ink accommodation capacity of the container relative to the inside volume thereof.

According to another aspect of the present invention, there is provided the casing has a substantial air vent, and has a prism-like configuration, wherein a corner portion of the liquid accommodating container defined by three sides of the prism configuration corresponds to a corner portion of the casing defined by three sides of the prism configuration, wherein a thickness of a wall constituting the liquid containing portion is thinner adjacent the corner portion than a central portion of sides of the prism-like configuration; the casing has a substantial air vent, and has a prism-like configuration, wherein corner portions of the liquid accommodating container each defined by two sides of the prism configuration corresponds to corner portions of the casing defined by two sides of the prism configuration, wherein the corner portions of the liquid containing portion include a first corner portion which separates from a corresponding one of the corner portions of the casing with discharge of the liquid out of the liquid accommodating container, and a second corner portion which substantially maintains a positional relation relative to the casing; or the liquid containing portion of the liquid accommodating container has a bent portion at a position opposing to a maximum area side of the liquid accommodating container, the bent portion separating from a wall of the casing with discharging of the liquid out of the liquid containing portion.

According to this aspect of the present invention, a negative pressure production type liquid accommodating container for an ink jet printing apparatus can be provided wherein the accommodation efficiency is increased, thus increasing the ink accommodation capacity of the container relative to the inside volume thereof.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 8(*a*) through 8(*c*) are schematic views of an ink container according to a second embodiment of present invention, wherein FIG. 8(*a*) is a sectional view, FIG. 8(*b*) is a bottom view, and FIG. 8(*c*) is a perspective view.

DESCRIPTION OF THE PREFERRED EMBODIMENTS

Referring to the accompanying drawings, the preferred embodiments of the present invention will be described. In the embodiments, the liquid accommodated in the liquid accommodating container (ink container) is ink as an example, but it may be another liquid such as processing liquid used for recording.

Figure 1:
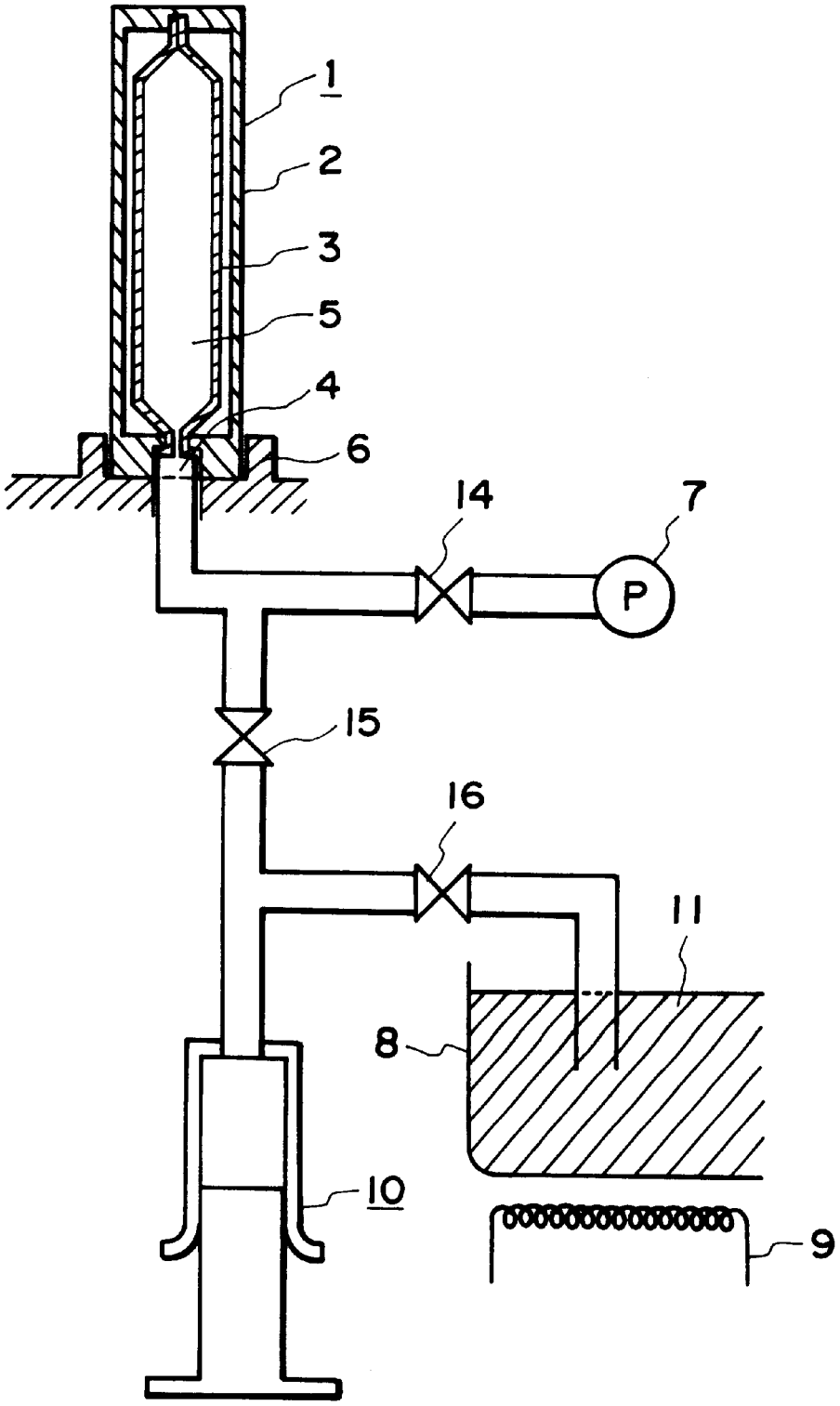
FIG. 1 is a schematic view of a liquid injecting apparatus usable with a liquid injection method according to an embodiment of the present invention.

Referring to FIG. 1, a liquid injection method according to the present invention will be described.

FIG. 1 is a schematic illustration of an example of a liquid injecting apparatus to which the liquid injection method of the present invention is applicable. In FIG. 1, designated by 1 is a liquid accommodating container having a liquid containing portion 5 which is constituted by a flexible liquid containing bladder (ink accommodation liquid containing bladder) 3. Designated by 2 is a casing for protecting the accommodation bladder 3, and 4 is a liquid discharge portion for discharging the liquid to the outside from the liquid containing portion 5. By mounting, to the liquid discharge portion 4, a liquid discharge permission member (not shown) for permitting discharge of the liquid to a recording head or the like, the liquid containing portion 5 constitutes a substantially hermetically sealed space.

First, the liquid discharge portion 4 of the liquid accommodating container 1 is set to a jig 6, and a valve 15 is closed. Then, the valve 14 is opened, and the air is discharged by a pump 7 from the liquid containing portion. Simultaneously therewith, ink 11 in an ink tank 8 is heated by a heater to approx. 60° C., and a valve 16 is opened to supply the ink from the ink tank 8 into a constant quantity injector 10. The quantity of the ink supplied thereto is 100% of the capacity of the liquid containing portion. After the supply of the ink, the valve 16 is closed.

After the air is discharged from the inside of the liquid containing portion 5, a valve 14 is closed, and a valve 15 is opened. Then, the ink is injected into the liquid containing portion 5 from the constant quantity injector device 10. After the injection of the constant amount of the ink, an unshown liquid discharge permission member is mounted to the liquid discharging portion 4 while paying attention to avoid air introduction, thus making the liquid containing portion 5 a substantially hermetically sealed chamber. In the present invention, if the temperature of the ink when the ink is injected is higher than the normal temperature, the advantageous effects which will be described hereinafter are provided, but the temperature is determined within the range in which the properties of the ink is not deteriorated by the temperature. In this embodiment, the temperature when the ink is injected is 60° C. This temperature is equivalent to the maximum temperature to which the liquid accommodating container is expected to be subjected, including the time of transportation, and the property of the ink is not deteriorated by this temperature. At this temperature, the amount of the air dissolved in the ink is about 1/10 of that dissolved in the ink filled at the normal temperature.

It is desirable that temperatures of the ink injection path and the liquid accommodating container which receives the injected ink, are equivalent to the temperature of the injected ink from the standpoint of decreasing the amount of the dissolved air in the ink in the liquid accommodating container. After the liquid containing portion is filled with the ink, it may be heated for a predetermined period while being connected with the ink injection path with the liquid discharging portion taking an upper position, so that dissolved air is discharged to the outside of the liquid accommodating container in the form of bubbles. The heating time is determined on the basis of the material of the ink, the temperature or the like. When it is 60° C., the period is desirably several hours.

Depending on the structure of the liquid discharge permission member, the liquid discharge permission member may be mounted first, and then the ink may be injected. In this case, too, the ink in the ink accommodating portion hardly contains dissolved air.

In this embodiment, the pressure reduction pressure reduction is used. However, a pressing injection is usable if the liquid temperature when it is injected into the liquid containing portion is higher than the normal temperature, and if the liquid is filled into the liquid containing portion in substantially hermetically sealed state. In such a case, the quantity, equal to 100% of the inside volume of the liquid containing portion, of the ink (or liquid) having a temperature higher than the normal temperature is supplied into the liquid containing portion, and is hermetically sealed without permitting introduction of the air into the ink.

Figure 2A:
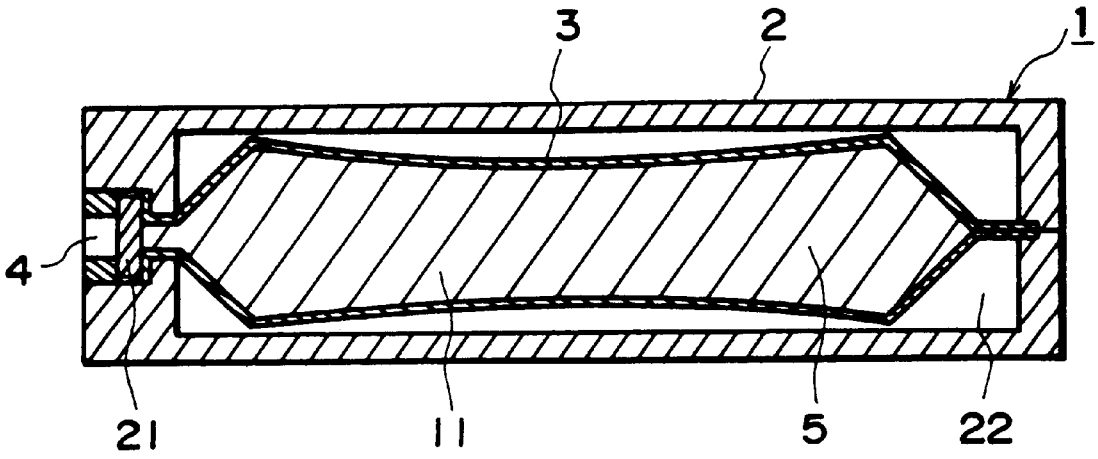
FIGS. 2(*a*) and 2(*b*) are schematic views showing a change of a liquid containing portion of a liquid accommodating container into which the liquid has been injected through a liquid injection method according to the present invention, relative to a change of an ambient temperature, wherein FIG. 2(*a*) deals with the case of the ambient temperature being normal temperature (approx.23° C.), and FIG. 2(*b*) deals with the case of the ambient temperature being higher than the normal temperature.
Figure 2B:
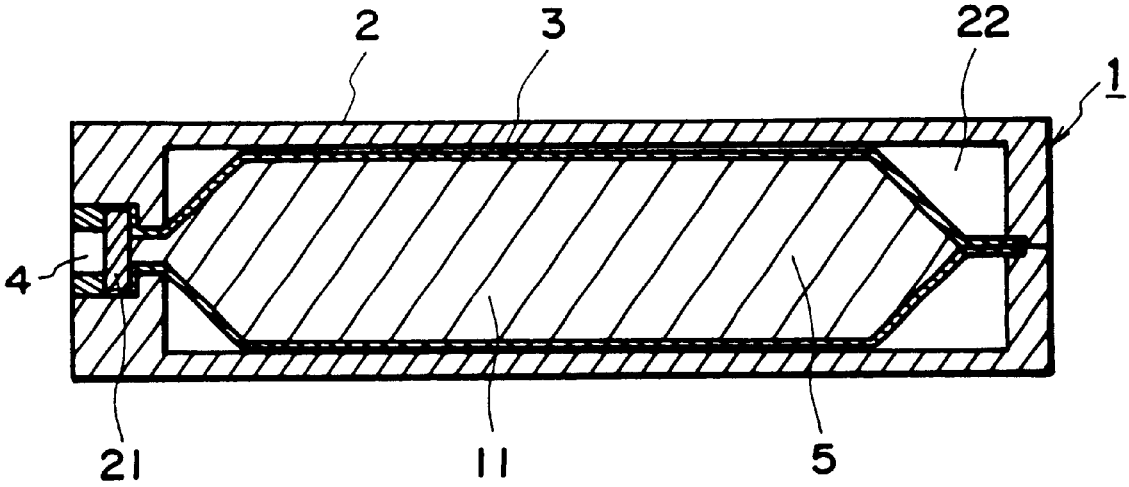
Figure 3A:
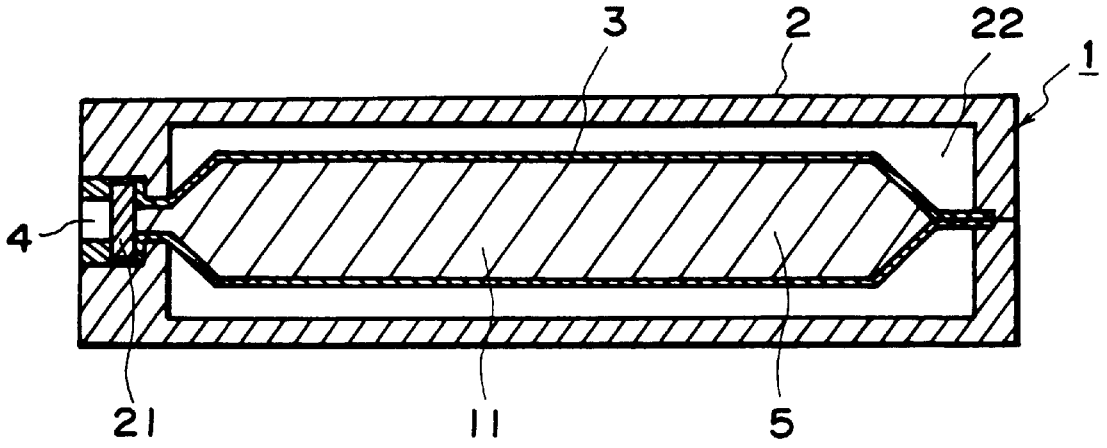
FIGS. 3(*a*) and 3(*b*) are schematic views showing a change of a liquid containing portion of a liquid accommodating container into which the liquid has been injected through a conventional liquid injection method, relative to a change of an ambient temperature, wherein FIG. 3(*a*) deals with the case of the ambient temperature being normal temperature, and FIG. 3(*b*) deals with the case of the ambient temperature being higher than the normal temperature.
Figure 3B:
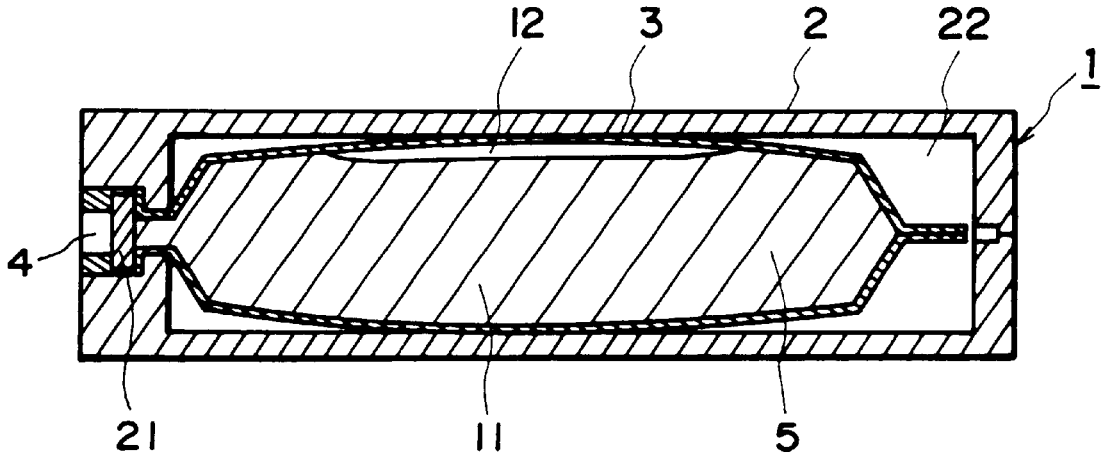

Referring to FIGS. 2 and 3, the description will be made as to the advantageous effect of the high temperature injection with substantial hermeticality.

FIGS. 2(*a*) and 2(*b*) illustrate change of the liquid containing portion relative to the change of the ambient temperature of the liquid accommodating container which has been filled with the ink using the liquid injection method of the present invention, and FIGS. 3(*a*) and 3(*b*) illustrate change of the liquid containing portion relative to the change of the ambient temperature of the liquid accommodating container which has been filled with the ink using a conventional liquid injection method. The containers of FIG. 2 and FIG. 3 are the same as that of FIG. 1. In these figures, FIGS. 2(*a*) and 2(*b*) show a state of the container when the ambient temperature is the normal temperature, and FIGS. 3(*a*) and 3(*b*) show a state of the container when the ambient temperature it higher than the normal temperature.

In the case of the conventional liquid injection method, as shown in FIG. 3(*b*) when the ambient temperature is higher than the normal temperature, the liquid containing portion 5 expands from the state shown in FIG. 3(*a*) by the expansion of the ink per se and by the precipitation of the air 12 having been dissolved in the ink into bubbles in the liquid containing portion 5.

In the bubbles, there are contained the air and vapor of a part of the contents of the ink. As a result, the influence of the volume expansion of the bubbles to the liquid accommodating container is much more significant than the volume expansion if the ink liquid. For example, when the liquid accommodating container which is filled with the 20° C. ink without heating, is placed under 60° C. ambience, the volume expansion rate of the liquid containing portion 5 is as large as approx. 2–3%.

In the worst case, the ink would leak out through the liquid discharge portion 4 although the liquid containing portion 5 is substantially hermetically sealed by the liquid discharge permission member 21. Accordingly, a gap 22 provided between the casing 2 and the ink accommodation bladder 3 has to be large in consideration of the presence of the bubbles as well as the expansion of the ink.

On the other hand, when the use is made with the liquid injection method of the present invention, even if the ambient temperature under which the liquid accommodating container is placed is higher than the normal temperature, a bubble is not precipitated in the liquid containing portion 5, as shown in FIG. 2(*b*) if the temperature is lower than that during the filling. Therefore, the gap 22 between the ink accommodation bladder 3 and the casing 2 when the temperature is normal, as shown in FIG. 2(*a*) may be enough if it corresponds to the volume decrease of the ink liquid by lowering of the temperature to the normal temperature, if the ink injection temperature is higher than the ambient temperature of the liquid accommodating container.

Even if the ambient temperature is higher than the injection filling temperature, the amount of the bubbles produced is far less than in the case of the conventional liquid accommodation entering method, and therefore, the gap 22 may be smaller, so that liquid accommodatable amount per unit volume of the liquid accommodating container can be increased.

Additionally, by preventing the air entering the liquid containing portion when the container is sealed, the ink ejection can be stabilized in the case of the piezoelectric type which is relatively easily influenced by the bubbles and dissolved air in the ink.

The description will be made as to the structure of the liquid accommodating container to which the liquid injection method of the present invention is applicable, and at so a mechanism for producing and maintaining a stabilized negative pressure.

(First embodiment)

Figure 4A:
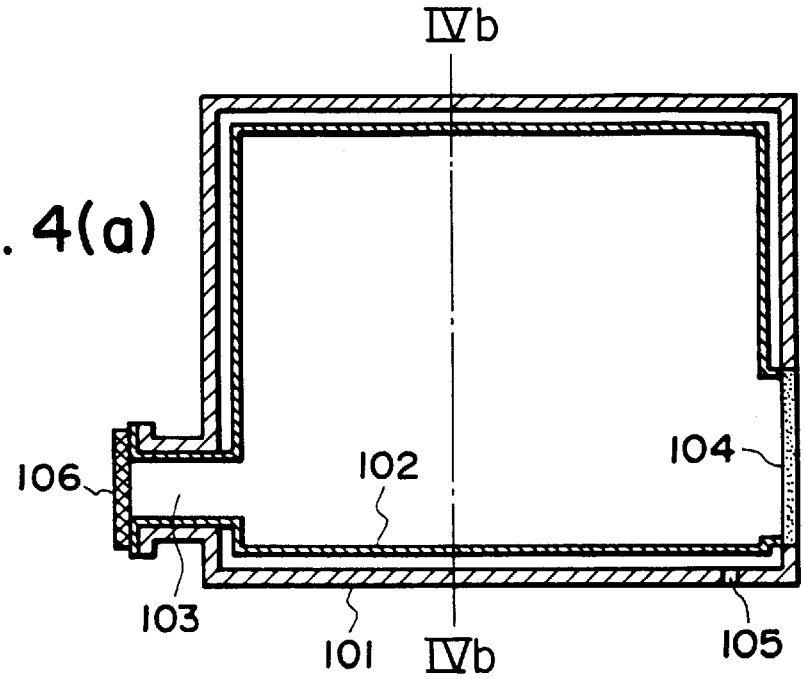
FIGS. 4(*a*) through 4(*c*) are schematic sectional views of an ink container according to a first embodiment of the present invention, wherein FIG. 4(*a*) is a sectional view, FIG. 4(*b*) is a side view, and FIG. 4(*c*) is a perspective view.
Figure 4B:
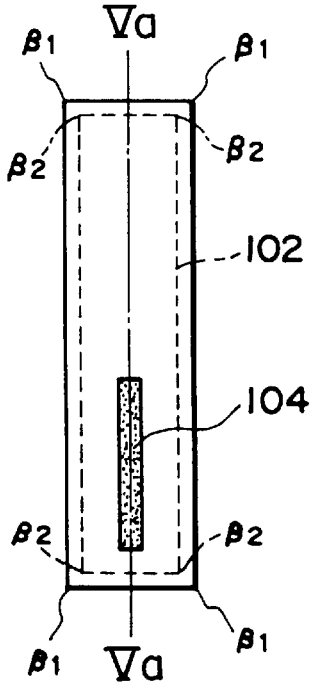
Figure 4C:
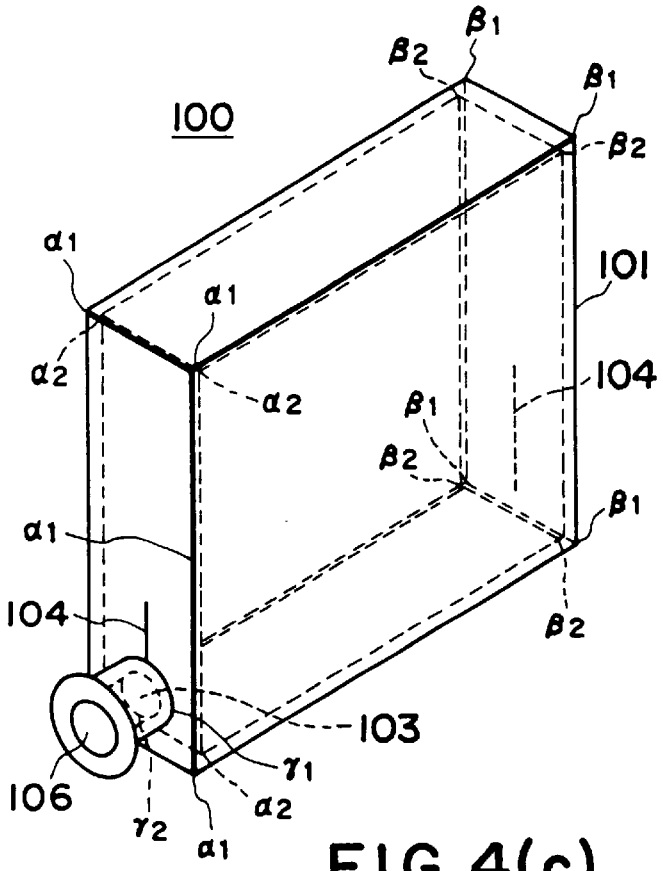
Figure 5:
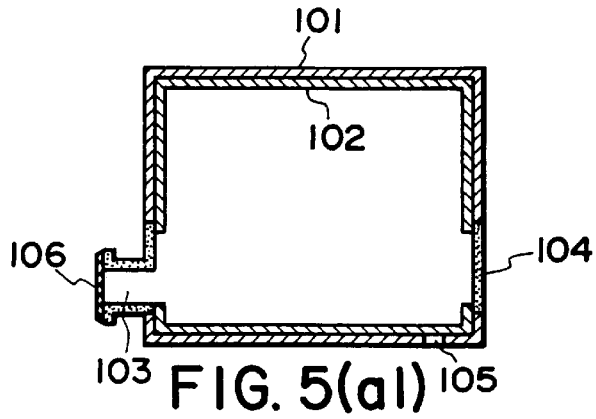
FIGS. 5(*a*1) through 5(*d*2) are schematic views showing a sequence of container deformation resulting from discharge of the ink in the ink container of FIG. 4.
Figure 5:
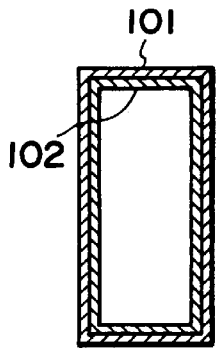
Figure 5:
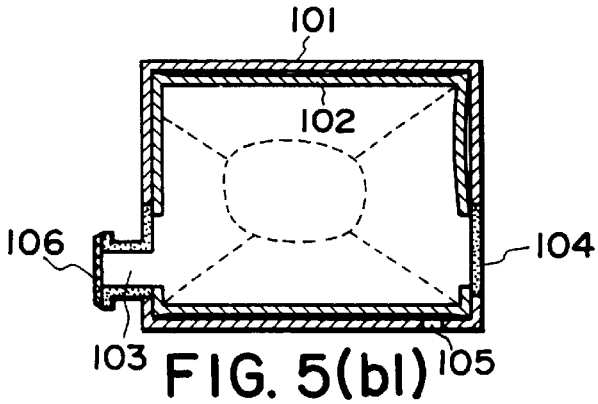
Figure 5:
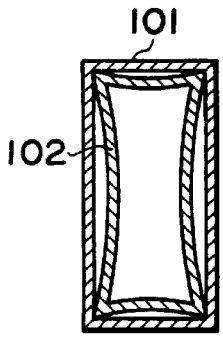
Figure 5:
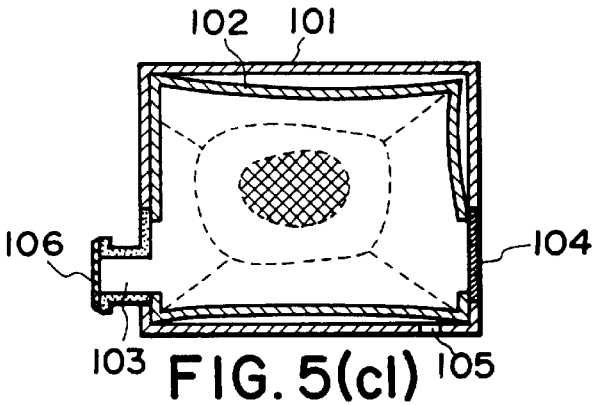
Figure 5:
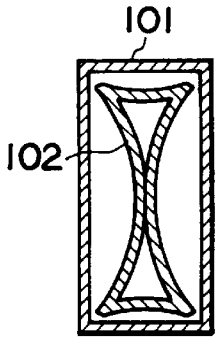
Figure 5:
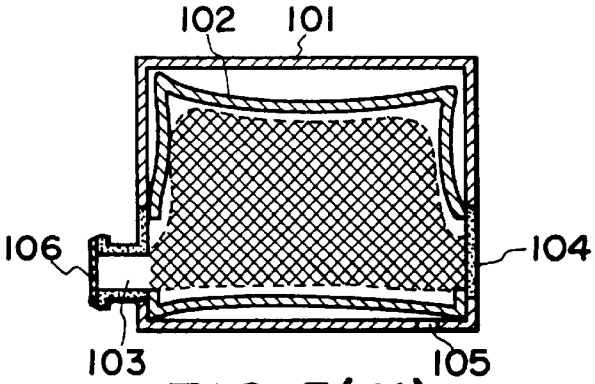
Figure 5:
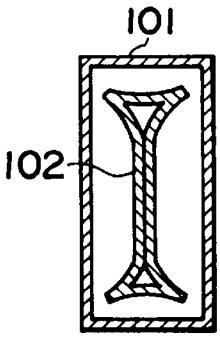

FIGS. 4(*a*)–(*c*) are schematic views of an ink container according to an embodiment of the present invention, wherein FIG. 4(*a*) is a sectional view thereof, FIG. 4(*b*) is a side view thereof, and FIG. 4(*c*) is a perspective view thereof. As will be understood from FIG. 4(*c*), the maximum area side among the sides constituting the outer wall of the container in FIG. 4 is shown indirectly FIG. 4(*a*). FIGS. 5(*a*1) through 5(*d*2) show a change of the ink container when the ink is discharged through the liquid discharging portion (from the ink supplying portion) of the ink container containing the ink, wherein suffix 1 (i.e., FIGS. 5(*a*1), 5(*b*1), 5(*c*1), and 5(*d*))indicates the Va—Va sectional view in FIG. 4(*b*), and suffix 2 i.e., FIGS. 5(*a*2), 5(*b*2), 5(*c*2) and 5(*d*2)) indicates the Vb—Vb sectional view of FIG. 4(*a*). The ink container of this embodiment is manufactured through a direct blow molding, with which an inner wall and an outer wall of the ink container are simultaneously molded through one step.

In FIG. 4, the ink container 100 comprises a casing in the form of an outer wall 101 and a flexible liquid containing portion (ink accommodating portion) in the form of an inner wall 102 separable from the outer wall 101, the liquid containing portion containing the ink (unshown). The outer wall 101 has a thickness sufficiently larger than the inner wall 102, and therefore, it hardly deforms even when the inner wall 102 deforms due to discharging of the ink. The outer wall is provided with an air vent 105. The inner wall has a welded portion (pinch-off portion) 104, and the inner wall is supported by and engaged with the outer wall at the welded portion. Designated by 106 is a liquid discharge permission member for substantially hermetically sealing the ink accommodating portion and for permitting the supply of the ink to the ink accommodating portion while keeping the hermetically sealed state when it is connected to the ink jet recording head. It is of rubber material in this embodiment.

The ink container 100 of FIG. 4 is constituted by six sides and a curved or cylindrical ink supplying portion 103. The maximum area sides of the inner and outer wall at the opposite sides of the ink supplying portion 103, among the 8 surfaces, are separated by six corner portions ($\alpha$1, $\beta$1, $\beta$1, $\beta$1, $\alpha$1), ($\alpha$2, $\beta$2, $\beta$2, $\beta$2, $\alpha$2), which will be described hereinafter.

The thickness distribution of the inner wall having the maximum area is such that thickness at the corner portion is thinner than that of the central portion, and the thickness gradually decreases toward the corner portion, so that it is convex toward the ink accommodating portion. The direction is the same as the direction of deformation of the surface, and it promotes the deformation, as will be described hereinafter. The corner of the inner wall is provided by 3 surfaces, which will be described hereinafter, so that strength of the corner as a whole is relatively high as compared with the strength of the central portion of the surfaces. However, the surfaces at and adjacent each corner has a thickness smaller than the center portions of the surfaces providing the corner, thus permitting easy movement of the surfaces, as will be described hereinafter. It is desirable that portions constituting the inner wall corner have substantially the same thicknesses.

In FIGS. 4 and 5, there seems to be a space between the outer wall 101 and the inner wall 102 of the ink container, since it is a schematic view, but they may be contacted to each other or spaced from each other with a small space, if they are separable. Therefore, in the initial state (initial state after start of use) wherein the ink is contained in the ink container, the corners α2, β2 of the inner wall 102 are at the inner side of the corners α1, β1 of the outer wall 101 (FIGS. 5(*a*1)), and (*a*2)) Here, the corner includes a crossing portion of at least 3 surfaces of polyhedron constituting the liquid container, and a portion corresponding to a crossing portion of extended surfaces thereof. The reference characters designating the corners are such that α means corners formed by the surfaces having the ink supply port, and β means the other corners; and suffix 1 is for the outer wall, and suffix 2 is for the inner wall. The crossing portions between the substantial flat surface and the curved surface of the cylindrical ink supplying portion is designated by γ; and the outer wall and inner wall are formed at the crossing portions, too, which are designated by γ1 and γ2. The corner may be rounded in a small range. In such a case, the round portions are deemed as corners, and the other surface portions are deemed as side surfaces.

The ink of the ink accommodating portion is supplied out in response to the ejections of the ink through the ink jet recording head of the ink jet recording means, in accordance with which the inner wall starts to deform in a direction of reducing the volume of the liquid accommodating portion, first at the central portion of the maximum area surface. The outer wall functions to constrain the displacement of the corners of the inner wall. In the ink container of this embodiment, position change of the corner portions α2, β2 hardly occurs, and therefore, the ink accommodating portion receives the deforming force due to the ink consumption and the restoring force in the direction of the initial shape, by which the negative pressure is stabilized.

At this time, the air is introduced through an air vent 105 into between the inner wall 102 and the outer wall 101, so that deformation of the inner wall is not impeded, and therefore, the stabilized negative pressure is maintained during the use or consumption of the ink. Thus, the space formed between the inner wall and the outer wall, is in fluid communication with the ambience through the air vent 105. Thereafter, the ink is retained in the ink accommodating portion by the balance between the force provided by the inner wall and the force provided by the meniscus formed at the ejection outlet of the recording head (FIGS. 5(*b*1), (*b*2)).

When quite a large amount of the ink is discharged to the outside (FIGS. 5(*c*1), (*c*2)), the ink accommodating portion deforms as described above, and the inward collapsing of the central portions of the ink accommodating portion is stabilized. The welded portions 104 function to constrain the deformation of the inner wall. Therefore, as for the sides adjacent to the maximum area sides, the portions not having the pinch-off portion 104 start to deform so as to become away from the outer wall earlier than the portions having the pinch-off portion 104.

However, only with these inner wall deformation constraining portions described above, the deformation of the inner wall adjacent to the liquid supplying portion may close the ink supplying portion before the ink contained in the ink accommodating portion is used up to sufficient extent.

Figure 6:
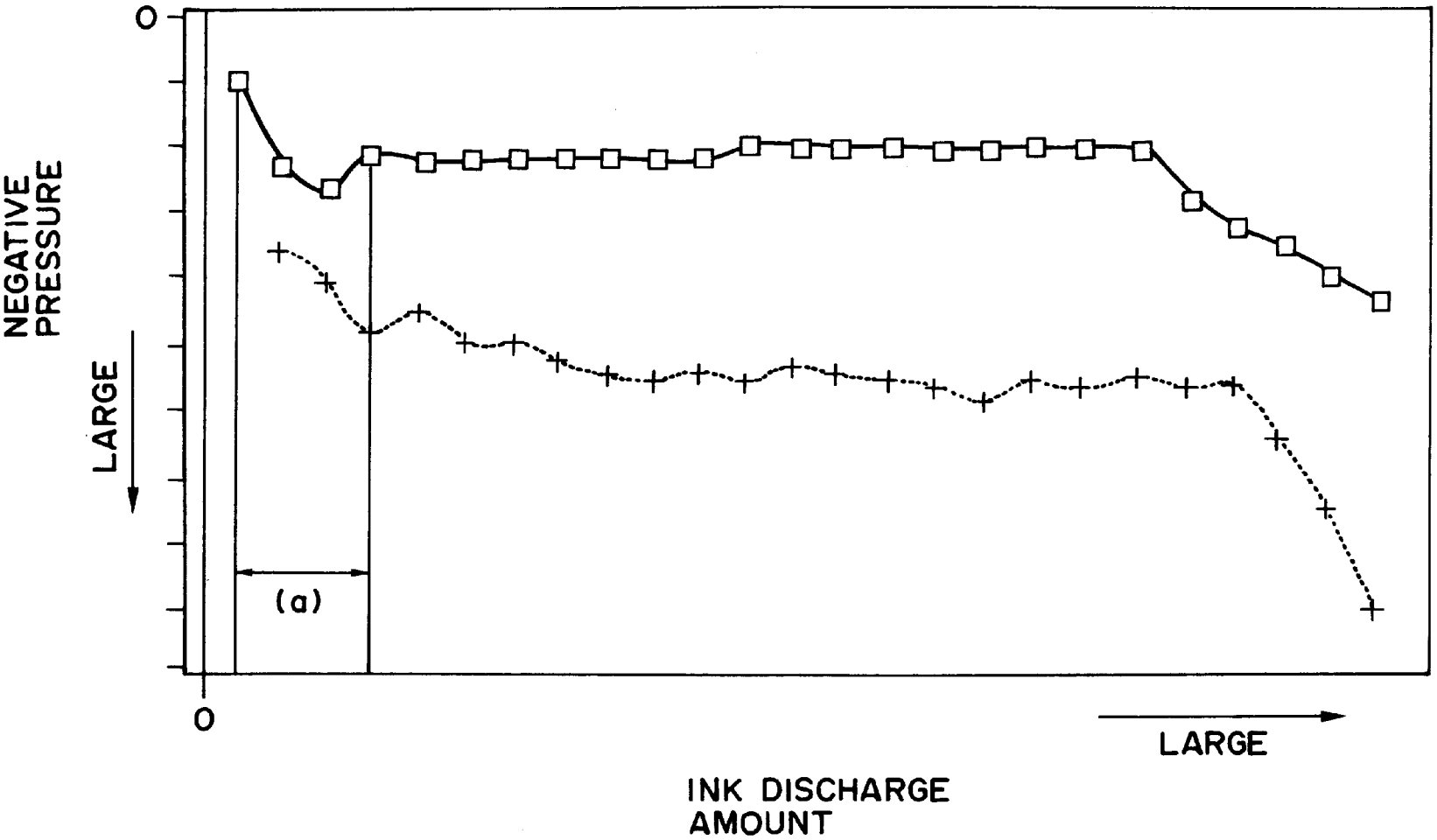
FIG. 6 schematically shows a negative pressure property of an ink container.
Figure 7A:
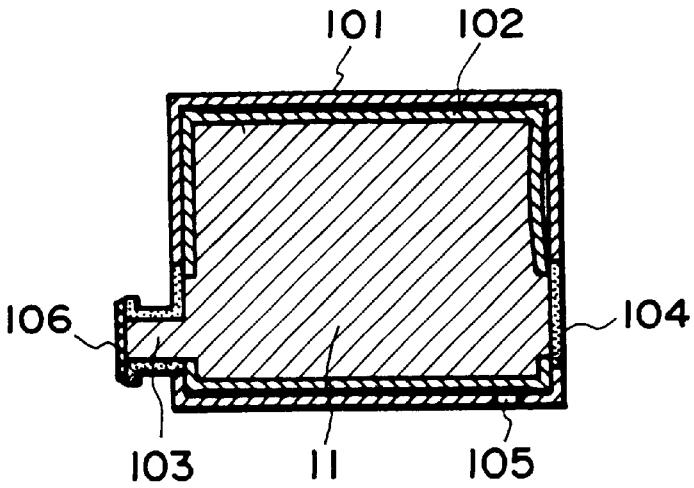
FIGS. 7(*a*) through 7(*d*) are schematic views showing a change of a liquid containing portion of an ink container of FIGS. 4*a*–4*c* into which liquid has been injected through a liquid injection method according to the present invention, relative to change of the ambient temperature.
Figure 7B:
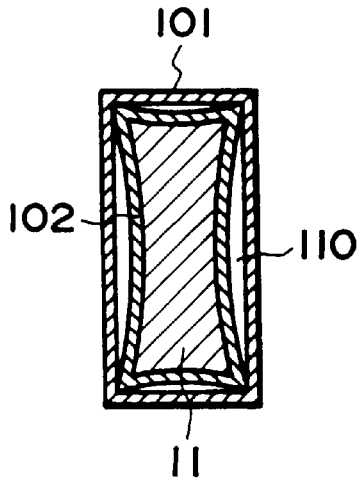
Figure 7C:
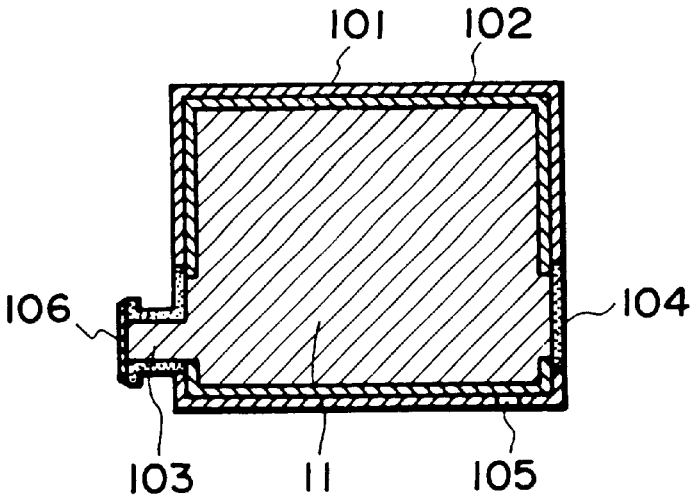
Figure 7D:
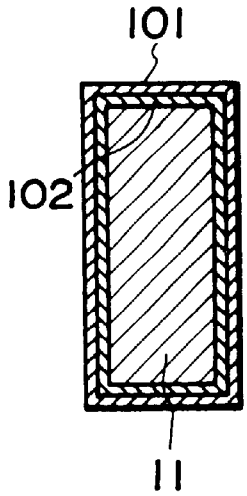
Figure 9A:
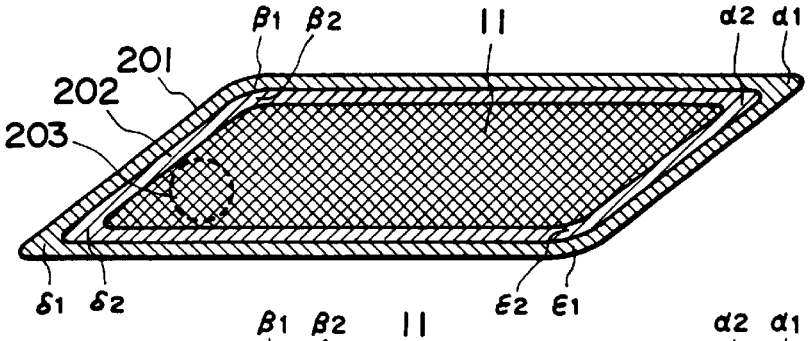
FIGS. 9(*a*) through 9(*d*) are schematic views showing a sequence of container deformation resulting from discharge of the ink from the ink container shown in FIG. 8.
Figure 9B:
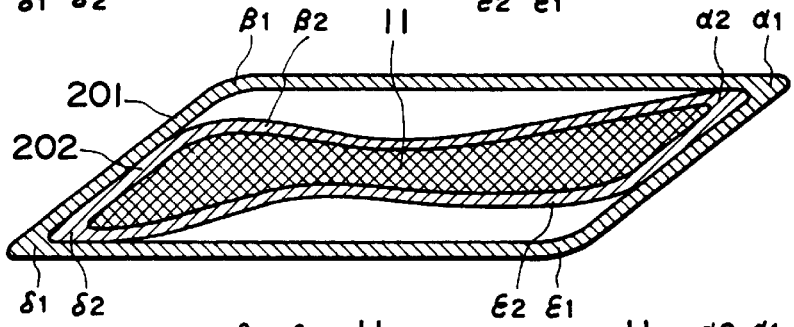
Figure 9C:
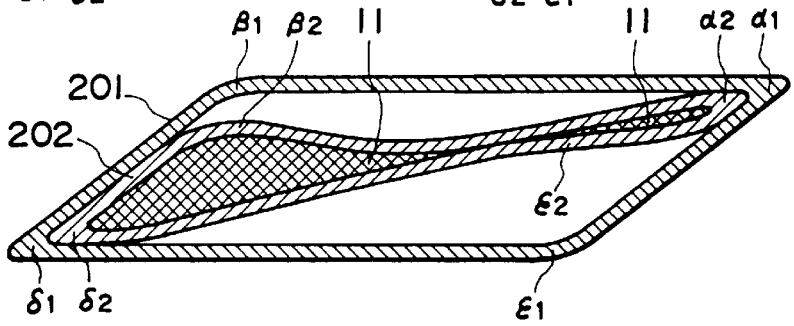
Figure 9D:
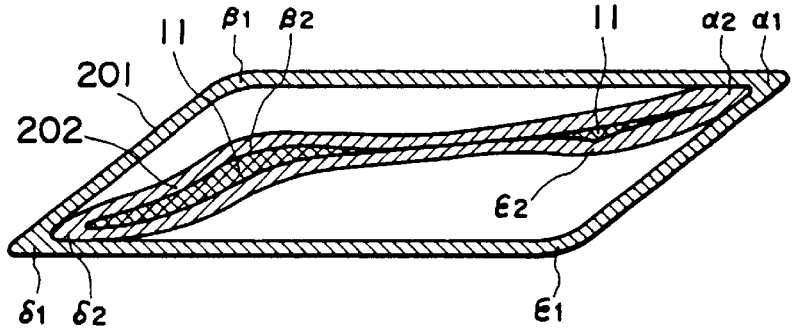

According to this embodiment, however, the corner α2 of the inner wall shown in FIG. 6(*c*), is adjacent along the corner α1 of the outer wall in the initial state, and therefore, when the inner wall is deformed, the corner of the inner wall is less easily deformed than the other portion of the inner wall, so that deformation of the inner wall is effectively constrained. In this embodiment, the angles of the corners α2 are 90 degrees.

Here, the angle of the corner α2 of the inner wall is defined as the corner α1 between two substantially flat surfaces of the at least 3 surfaces of the outer wall, namely, as the portion of the crossing portion of the extensions of the 2 surfaces. The angle of the corner of the inner wall is defined as the angle of the corner of the outer wall, because in the manufacturing step which will be described hereinafter, the container is manufactured on the basis of the outer wall and because the inner wall and outer wall are similar in configuration in the initial state. Thus, as will be understood from FIGS. 5(*c*1) and (*c*2), the corner α2 of the inner wall shown in FIG. 4(*c*) is provided separably from the corresponding corner of the outer wall, and on the other hand, the corner β2 of the inner wall other than the corner formed by the surfaces having the ink supply port, is slightly separated from the corner α2 of the correspondence outer wall as compared with the corner α2. However, in the embodiment of FIGS. 4 and 5, the angle β at the opposite position is generally not more than 90 degrees. Therefore, the positional relation relative to the outer wall can be maintained close to the initial state as compared with the other parts of the inner wall constituting the ink accommodating portion, so as to provide an auxiliary support for the inner wall.

Furthermore, in FIGS. 5(*c*1) and (*c*2), the opposite maximum surface area sides are substantially simultaneously deformed, and therefore, the center portions thereof are brought into contact with each other. The contact portion of the center portions (FIGS. 5(*c*1) and (*d*1), hatched portion) expands with further ink discharge. In other words, in the liquid container of this embodiment, the opposite maximum area sides of the container start to contact before the edge formed between the maximum area side and the side adjacent to thereto, collapses, with the consumption of the liquid. FIGS. 5(*d*1) and (*d*2) show the state in which substantially the entirety of the liquid is used up from the liquid accommodating portion (final state). In this state, the contact portion of the ink accommodating portion, expands substantially over the entirety of the ink accommodating portion, and one or some of the corners β2 of the inner wall are completely separated from the corresponding corners β1 of the outer wall. On the other hand, the corner α2 of the inner wall is still separably positioned closely to the corresponding corner α1 of the outer wall even in the final state, so that corner functions to constrain the deformation to the end. Before this state is reached, the welded portion 104 may have been separated from the outer wall, depending on the thickness of the inner wall. Even in that case, the length of the welded portion 104 is maintained, and therefore, the direction of the deformation is limited. Therefore, even when the welded portion is disengaged from the outer wall, the deformation is not irregular but is balanced.

As described in the foregoing, the deformation starts at the maximum area sides, which then are brought into surface contact with each other before an edge of the maximum area sides are collapsed, and the contact area increases. The corners other than the corners constituted by the side having the ink supplying portion are permitted to move. Thus, the order of precedence of deforming portions of the ink accommodating portion is provided by the structure thereof. At least one of the maximum area sides of the substantially flat sides of the outer wall of the ink container having a substantially prism configuration, is not fixed to the inner wall. This will be described in detail. When the amount of the ink in the ink accommodating portion reduces by the ejection of the ink from the ink jet recording head, the inner wall of the liquid container tends to deform at the portion which is easiest to deform under the constraint described above. Since at least one of the substantially flat maximum surface area sides of the polyhedron shape, is not fixed to the inner wall, the deformation starts at substantially the central portion of the internal wall surface corresponding to this side.

Since the side at which the deformation starts, is flat, it smoothly and continuously deforms toward the side opposite therefrom corresponding to the decrease amount of the ink in the ink accommodating portion. Therefore, during the repeated ejection and non-ejection, the ink accommodating portion does not deform substantially noncontinuously, so that further stabilized negative pressure can be maintained, which is desirable for the ink ejection of the ink jet recording apparatus. In this embodiment, the maximum surface area sides are opposed to each other and are not fixed to the outer wall and therefore are easily separable from the outer wall thereat, and therefore, the two opposite sides deform substantially simultaneously toward each other, so that maintaining of the negative pressure and the stabilization of the negative pressure during the ink ejections can be further improved. The volume of the ink container for the ink jet in this embodiment is usually approx. 5–100 $cm^3$, and is 500 $cm^3$ at a typical maximum. In the ink container of the present invention, the area of the maximum area sides is larger than the sum of the areas of the sides adjacent thereto.

The experiments have been carried out with a liquid container having a thickness of approx. 100 microns at the central portion of the inner wall, and having a thickness of several −10 microns adjacent to the corner. In this case, the corner is provided by a crossing portion of the 3 surfaces, the strength of the corner substantially corresponds to that of the tripled thickness namely 10×3=30 microns approx.

In the initial stage of the start of the liquid discharge, the desired negative pressure can be produced by the constraint of the collapse of the corners and the crossing portions between the surfaces or sides. With the further discharge of the liquid, the deformation occurs and increases at the center portions of the maximum area sides of the container. Then, the corners of the sides of the inner wall begin to become away from the corresponding corners of the outer wall. Immediately after the separation of the corners, the original configuration of the corners tend to be maintained so that deformation of the corners is constrained. However, with further liquid discharge, the configuration of the corners are gradually deformed since the thickness is as small as 100 microns.

However, all of the corner constituting the liquid container are not simultaneously separated and deformed, but they occur in the predetermined precedence order. The precedence order is determined by the configuration of the liquid container, corner conditions such as film thickness, the position of the pinch-off portion where the inner wall is welded and is sandwiched by the outer wall, or the like. By the provision of the pinch-off portion at the positions as in this embodiment, the deformation of the inner wall and the separation thereof from the outer wall can be regulated at the positions, so that irregular deformation of the inner wall can be prevented. Additionally, the provision of the pinch-off portions at opposite positions as in this embodiment, the negative pressure can be further stabilized.

By the subsequent separation of the corners constituting the liquid container, the predetermined negative pressure can be produced stably from the initial stage of the liquid discharge to the end thereof. With the thickness of the inner wall about 100 microns as in this embodiment, the crossing portion between the adjacent surfaces and the corners are irregularly deformed namely toward the liquid supplying portion, at the time when the liquid is used up.

The similar experiments were carried out with a liquid container having a thickness of 100–400 microns at the central portions of the inner wall and a thickness of 20–200 microns adjacent to the corners. In such a case, the strength of the corners were quite higher than in the foregoing sample of the container.

With this container, the predetermined negative pressure were produced at the initial stage of the liquid discharge, similarly to the foregoing example. With the further consumption of the ink, the inner wall begin to gradually separate from the outer wall at the central portion of the sides. Corresponding to the deformation, the corners begin to separate from the corresponding corners of the outer wall. The deformation of the corners is small even after quite a large amount of the liquid is discharged. Since the corner is separated from the outer wall with the initial configuration is substantially maintained, the negative pressure is stabilized. At the end of the consumption of the ink, the configuration is stabilized, so that negative pressure is provided stably to the end of use of the ink with the minimum remaining amount of the ink.

As a result of additional experiments, it has been found that stabilized negative pressure can be generated when the thickness adjacent to the central portion of the inner wall is 100–250 microns, and the thickness adjacent to the corner is 20–80 microns.

FIG. 6 shows a relation between the ink use amount of the ink accommodating portion and the negative pressure of the ink container in the ink container according to this embodiment. In FIG. 6, the abscissa represents the ink discharge amount, and the ordinate represents the negative pressure. In this Figure, the negative static pressure is plotted with square marks. A total negative pressure which is a sum of the negative static pressure and the dynamic negative pressure produced when the ink flows, is plotted by "+" marks. The discharge amount of the ink in FIG. 6 is zero when the ink accommodating portion is in close contact with the casing, which is the same state as when 100% of the ink is injected into the ink container, and the container is at the temperature at the time of the injection.

Here, the negative pressure in the ink accommodating portion is preferably as follows.

1. First, the negative static pressure at the time of shipment of the ink container s to the market is approx. −2 to −30 mmAq. relative to the ambient pressure. If the pressure is positive at the delivery, a proper negative pressure can be provided by an initial refreshing operation in the main assembly of the state at the time of delivery recording device, for example. Here, "the state at the time of delivery" is not limited to the initial state shown in FIGS. 5(*a*1) and (*a*2). If the negative pressure is maintained, the container may contain an amount of the ink which is slightly smaller than the maximum accommodatable amount of the ink accommodating portion, as shown in FIGS. 5(*b*1) and (*b*2).

2. Secondly, the pressure difference between when the recording is effected and when it is not effected, is small, namely, the difference between the negative static pressure and the total pressure is small. This is accomplished by reducing the dynamic pressure. The dynamic pressure in the ink accommodating portion per se can be neglected as contrasted to the ink accommodating portion using a porous material, and therefore, the small dynamic pressure can be easily accomplished.

3. Thirdly, the change in the negative static pressure due to the change of the ink amount in the ink accommodating portion is small from the initial state to the final state. In a simple structure of the ink accommodating portion, the negative static pressure changes linearly or non-linearly relative to the ink amount existing in the ink accommodating portion, and therefore, the change ratio of the static pressure is large. However, in the ink container of this embodiment, the change of the negative static pressure is small from the initial stage to immediately before final state, as shown in FIG. 6, so that substantially stabilized negative static pressure is accomplished. As regards the ink jet recording field, the negative pressure generation is stably provided by the ink container of this embodiment, and since the volume capacity efficiency is large, this embodiment is suitable for the small size ink jet recording apparatus, the demand for which is great these days.

The description will be made as to the manufacturing method of the above-described ink container and as to the liquid injection method to the liquid accommodating container.

The ink container of an embodiment of the present invention has a double wall structure of molding resin material, wherein the outer wall has a thickness to provide high strength, and the inner wall is of soft material. With small thickness, thus permitting it to follow the volume variation of the liquid. It is preferable that inner wall has an anti-liquid property, and the outer wall has a shock resistant property or the like.

In this embodiment, the manufacturing method for the liquid container uses a blow molding method with the use of blowing air. This is for the purpose of forming the wall constituting the ink container from a resin material not expanded substantially. By doing so, the inner wall of the ink container constituting the ink accommodating portion can resist the load substantially uniformly in any direction. Therefore, despite the swing motion, in any direction, of the ink in the inner wall of the ink container after some amount of the ink is consumed, the inner wall can assuredly maintain the ink, thus improving the total durability of the ink container.

As for the blow molding method, there are a method using injection blow, a method using direct blow, and a method using double wall blow. The description will be made as to the method using the direct blow molding used in this embodiment.

The injection nozzle is in the form of a multi-layer nozzle, and it injects the inside resin material and the outside resin material simultaneously into the mold to produce an integral first and second parison. The materials of the inside resin material and the outside resin material are so selected as to avoid the welding of the resin materials at the contact portion therebetween. When similar materials are to be used from the standpoint of the liquid contact property relative to the ink, the inside material or the outside material may be of multi-layer structure so that resin materials are supplied in such a manner that different kind materials are present in the contact portion.

A metal mold is moved to sandwich the integral parison, and the air is injected to effect blow molding into the shape of the metal mold. At this time, the inner wall and the outer wall are closely close contacted without gap therebetween. The parison is processed while it has a viscosity, and therefore, both of the outer wall resin material and the inner wall resin material are free of orientation property. By the use of the blow molding for manufacturing the liquid container, the number of steps and the number of parts are reduced, so that yield is improved; and additionally, the configuration of the inner wall 102 can be made such that corner portions of the inner wall 102 correspond to the corner portions of the outer wall 101, as shown in FIG. 4. Then, the cylindrical parison is pushed to the mold having a polygonal section by the blow molding, by which the thickness distribution of the inner wall as described in conjunction with FIG. 4, can be accomplished, and as regards the outer wall, similarly to the inner wall, the thickness distribution in which the thickness is large in the central portion and decreases toward the marginal portions.

Then, the inner and outer walls are separated at other than the ink supplying portion. As for another separation method, the molding resin materials of the inner wall and the outer wall have different thermal expansion coefficients (shrinkage rates). In this case, the separation is effected automatically by decrease of the temperature of the molded product after the blow molding, so that number of manufacturing steps can be decreased. The portion having been sandwiched by the molds during the blow molding may be imparted by external force after the molding to separate the outer wall from the inner wall, and the gap therebetween may be brought into communication with the air, so that gap can be used as an air vent. This is preferable in an ink container since then the number of manufacturing steps can be reduced.

After the ink container is integrally molded except for the ink supply port in this manner, the ink is injected.

FIGS. 7(*a*1) through 7(*b*2) show the change of the liquid containing portion relative to the change of the ambient temperature when the ink container is filled with the ink through the injection method of the present invention, wherein 7(*a*1) and 7(*a*2) show the case in which the liquid accommodating container is placed under the normal ambient temperature, 7(*b*1) and 7(*b*2) show the case in which the liquid accommodating container is placed under the ambient temperature which is higher than the normal temperature; and suffix 1 (i,e., FIGS. 7(*a*1) and 7(*b*1) indicates the Va—Va sectional view of FIG. 4(*b*), and suffix 2 indicates the Vb—Vb sectional view of FIG. 4(*a*).

When the ink is to be injected into the ink accommodating portion, the ink injecting apparatus as shown in FIG. 1, for example, is used, and the ink is heated up to a temperature higher than the normal temperature. Subsequently, 100% (capacity of the ink accommodating portion) of the ink is injected thereinto. The ink supply port is plugged with a liquid discharge permission member without introduction of the air into the ink accommodating portion, thus sealing the ink accommodating portion. FIGS. 7(*b*1) and (*b*2) shows this state.

When the ink container is placed under the normal ambient temperature, a gap 110 exists between the outer wall and the inner wall as shown in FIGS. 7(*a*1) and (*a*2). However, the gap is the one produced by reduction of the volume of the ink (liquid) due to the temperature at the time of ink filling returning to the normal temperature, and when the ambient temperature becomes equal to the high temperature, the gap disappears as shown in FIGS 7(*b*1) and (*b*2). In this embodiment, the material of the inner wall of the ink container is polyethylene, and the liquid discharge permission member of olefin rubber sheet is welded to the ink supply port by ultrasonic welding. By using the ultrasonic welding, the connection between the inner wall and the liquid discharge permission member is assured at the ink supply port so that hermetical sealing is accomplished. Thus, the ink leakage other than when the container is connected with the recording head, and the liquid can be supplied out to the ink jet recording head by connection therewith using a hollow needle or the like. By the use of the rubber sheet for the liquid discharge permission member, even if the mounting and demounting of the ink container relative to the recording head are repeated, the state of permitting the ink discharge only when they are connected can be maintained.

Thus, with the ink container shown in FIG. 4, the configuration of the inner wall 102 can be provided such that corner portions of the inner wall 102 take the positions corresponding to the respective corner portions of the outer wall 101 along the configuration of the outer wall 101, and therefore, the outer wall has the inner side equivalent to the outer surface of the inner wall. Accordingly, when the liquid injection method of the present invention is used, almost all of the inside of the casing except for the volume of the ink expansion, can be used for accommodating the ink. In other words, the ink accommodatable amount per unit volume in the inside of the ink container casing when the ink expansion is taken into account, can be maximized.

By using the liquid injection method of the present invention, the stabilized negative pressure can be produced from the beginning of use, without long using of the initial unstable region in the negative pressure property curve of FIG. 6 (region (a)) when the ambient temperature is substantially at the normal temperature. This is because under the normal temperature, it is as if the ink is discharged after a part of the ink is discharged from the container, as shown in FIGS. 7(*a*1) and (*a*2), when the injection method of the present invention is used.

Additionally, as shown in FIGS. 7(*a*1) and (*a*2), the shock resistance is high during transportation of the container since the corner portions of the inner wall correspond to the corner portions of the outer wall without separation.

(Second embodiment)

Figure 10A:
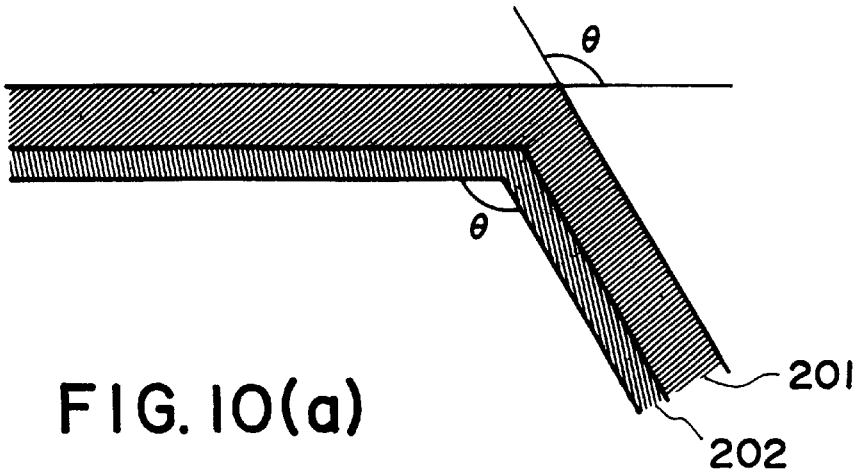
FIGS. 10(*a*) through 10(*c*) illustrate a definition of an angle of a corner portion in a liquid accommodating container according to the second embodiment of the present invention.
Figure 10B:
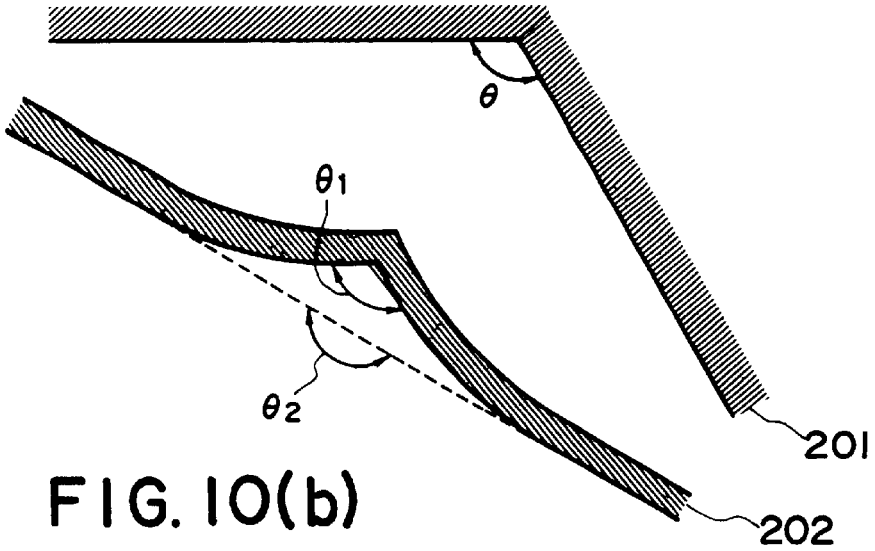
Figure 10C:
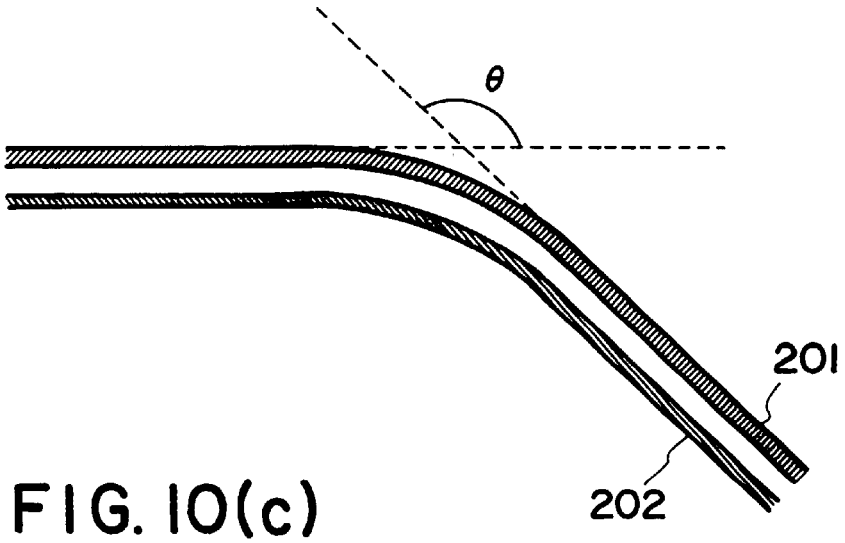
Figure 11A:
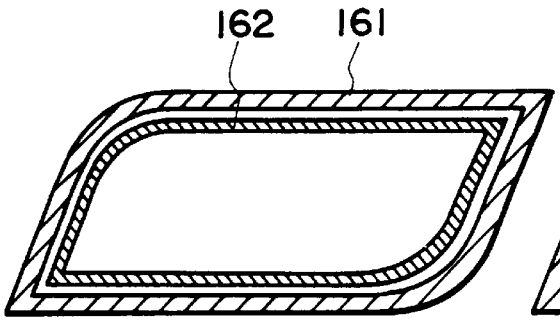
FIGS. 11(*a*) through 11(*c*) are illustrations showing an advantage when a small curved surface is formed at a corner portion of the liquid accommodating container according to the second embodiment.
Figure 11C:
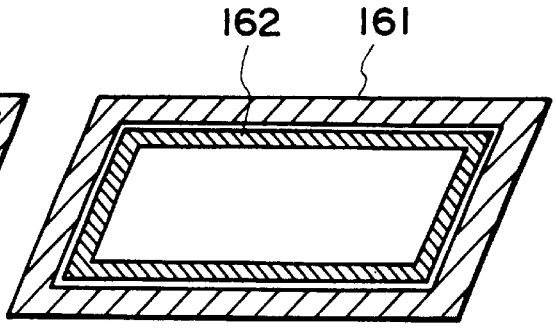
Figure 11B:
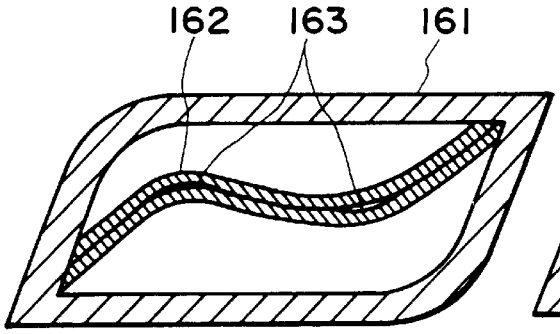
Figure 11D:
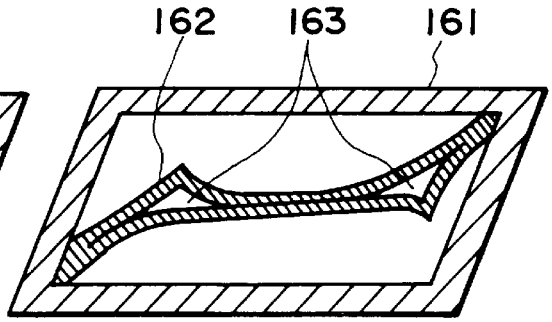

FIGS. 8(*a*)–(*c*) are schematic views of an ink container according to an embodiment of the present invention, wherein FIG. 8(*a*) is a sectional view thereof, FIG. 8(*b*) is a side view thereof, and FIG. 8(*c*) is a perspective view thereof. FIGS. 9(*a*) through 9(*d*) show a change, in the IX—IX sectional view of FIG. 8(*a*), of the ink container when the ink is discharged through the liquid discharging portion (from the ink supplying portion) of the ink container containing the ink. FIGS. 10(*a*)–(*c*) are schematic illustrations of an angle of a corner portion in the ink container of the present invention. The ink container of this embodiment is manufactured through a direct blow molding method, as in the first embodiment.

Similarly to the first embodiment, the ink container 200 of FIG. 8 comprises an outer wall 201 and an inner wall 202 which is separable from the outer wall, the region defined by the inner wall (ink accommodating portion) functioning to contain the ink. The outer wall is provided with an air vent 205. The inner wall has a welded portion (pinch-off portion) 104, and the inner wall is supported by and engaged with the outer wall at the welded portion.

The ink container 200 of FIG. 8 comprises a substantially quadratic prism portion having a parallelogram bottom surface and a cylindrical ink supplying portion 203 connected thereto, as a curved portion. The ink container has a small curved or rounded portion (R) at a portion corresponding to the edge lines of the prism shape. Here, the portion of the container adjacent the crossing portion between two surfaces preferably two flat surfaces or the crossing portion of the extensions of the surfaces, are called a "corner portion". The surfaces having the maximum area among the surfaces defined by the corner portion in each of the inner and outer walls, are faced to each other at both of the lateral sides of the ink supplying portion 203.

In FIG. 8(*b*), θ, φ are angles formed between outer walls constituting the corner portion of the ink container, more particularly, they are angles formed at the crossing portion of extensions of two surfaces, as shown in FIGS. 10(*a*), (*c*). Angle θ is larger than 90 degrees, and angle φ is smaller than 90 degrees. In this embodiment, θ is approx. 140 degrees, and φ is approx. 40 degrees. The angle of the outer wall can be easily controlled since the manufacturing of the ink container carried out on the basis of the outer wall, as will be described hereinafter. The inner wall is formed so as to be corresponding to the outer wall, and therefore, the angles of the inner wall upon the start of use (initial state) are substantially the same as the angles of the corresponding portions of outer wall, as shown in FIG. 10(*a*). The ink container of this embodiment has a substantially prism configuration, and when it is cut along a plane parallel to the bottom surface, as shown in FIG. 9, the surface taken along the plane has a substantially parallelogram configuration. At least one of the angles formed between one side and adjacent side of the polygonal shape is larger than 0 degree and less than 90 degrees, and the angles formed between said two sides and the sides which are different from the two sides and which are adjacent said two sides, are larger than 90 degrees and smaller than 180 degrees, respectively. The cutting plane is perpendicular to the maximum area surfaces.

The ink supplying portion 203 is connected with an unshown ink jet recording means through an ink discharge permission member 206 having an ink leakage preventing function capable of preventing leakage of the ink when small vibration or external pressure is imparted to the container. At the ink supplying portion 203, the inner wall and the outer wall are not easily separated from each other by the ink discharge permission member 206 and another structure therearound. The size of the ink supplying portion is sufficiently small as compared with the ink accommodating portion, and therefore, the ink supplying portion is not easily collapsed even when the deformation of the inner wall resulting from the discharge of the ink. Therefore, even when the ink is completely consumed, the inner wall and the outer wall are not deformed at the ink supplying portion and maintain the initial state. Since FIG. 8 is a schematic view, it seems that space exists between the outer wall 201 and the inner wall 202 of the ink container. But, it will suffice, if they are separable, and the inner wall and the outer wall may be in contact with each other, or may be spaced with a small gap. In any case, the corner portion of the inner wall is disposed at a position at least corresponding to the corner portion of the outer wall along the configuration of the inner surface of the outer wall 201, in the initial state shown in FIG. 9(*a*).

In FIG. 9, designated by 11 is the ink. In FIG. 9(*a*), the position of the corresponding ink supplying portion 203 is indicated by a broken line, but in FIGS. 9(*b*)–(*d*), the position of the ink supplying portion is omitted for better understanding of the deformation of the inner wall.

When the ink is ejected from the ink jet recording head of the ink jet recording means, the ink is consumed from the ink accommodating portion, and the maximum area sides of the inner wall 102 of the ink container begins to deform at the central portions thereof in the direction of reducing the volume of the ink accommodating portion. The corner portion α1 shown in FIG. 1(*c*) among the corner portions of the outer wall, limits the movement of the corner portion α2 of the inner wall to keep the positional relation therebetween. On the other hand, the corner portion β2 of the inner wall is disengaged from the correspondence corner portion β1 of the outer wall to suppress the deformation of the inner wall. In other words, as regards the polygonal shape on the cutting plane (in the case of FIG. 9, the cutting plane parallel to the bottom surface) perpendicular to the maximum area surface of the ink container inner wall, the deformation occurs such that one (φ) of the angles formed between a side and a side adjacent thereto is reduced, and that angles (θ) formed between the sides forming said angle and the sides adjacent thereto, are increased.

This occurs because the angles of the polygonal shape formed in the cutting plane are different, and therefore, the forces applied resulting from the ink discharge at the angle reducing corner (δ2) and the angle increasing corners (δ1) of the inner wall, are different. As a result, the abovedescribed position variation of the corner portion δ2 hardly occurs, and therefore, the ink accommodating portion receives the deforming force due to the ink consumption and the restoring force in the direction of the initial shape, by which the negative pressure is stabilized.

At this time, the air is introduced through an air vent 205 into between the inner wall 202 and the outer wall 201, so that deformation of the inner wall is not impeded, and therefore, the stabilized negative pressure is maintained during the use or consumption of the ink. Thus, the space formed between the inner wall and the outer wall, is in fluid communication with the ambience through the air vent 205. Thereafter, the ink is retained in the ink accommodating portion by the balance between the force provided by the inner wall and the force provided by the meniscus formed at the ejection outlet of the recording head (FIG. 9(*b*)).

Furthermore, when quite a large amount of the ink is discharged out of the ink accommodating portion, and therefore, the ink accommodating portion is further deformed (FIG. 9(*c*)), the welded portion 204 also functions as a deformation limiting portion for the inner wall so that disengagement of inner wall from the outer wall is suppressed at the side having the supply port and the side faced thereto. As a result, the positional relation between the corner portion ζ1 of the outer wall in the side having the supply port and the corner portion ζ2 of the inner wall, is maintained, and therefore, the supply port portion is not plugged by the adjacent internal wall surface. The corner portion ε2 of the inner wall disengaged from the corner portion of the outer wall, is brought into contact to the maximum area surface opposing thereto. The contact portion increases in its area by the further consumption of the ink.

Sooner or later, the ink ejection becomes not possible from the ink jet recording head. This state is shown in FIG. 9(*d*) (final state). With this state, the contact portion of the ink accommodating portion is generally as large as the entirety of the ink accommodating portion. Depending on the thickness of the inner wall, the welded portion 204 may be separated from the outer wall. In this case, the direction of the deformation is limited since the welded portion 204 has a certain length in a direction as shown in FIGS. 8(*a*) and (*b*). Therefore, even when the welded portion is disengaged from the outer wall, the deformation is not irregular but is balanced.

The foregoing is the description of the change when the ink container of the present invention is filled with the ink, and the ink is discharged from the ink supplying portion thereafter. The deformation starts at the maximum area surfaces, and the order of the deformations of various parts of the inner wall is positively determined by the provisions of the corner portion of the inner wall disengageable from the corresponding corner portion of the outer wall and the corner portion of the inner wall which is maintained, in the positional relation, with the corner portion of the outer wall.

In the foregoing description, with respect to at least one of the cutting planes perpendicular to the maximum area surface of the inner wall of the ink container, the deformation occurs such that angle formed between one side constituting the substantially polygonal shape in the cutting plane, reduces or increases. Here, the angle of the inner wall, as shown in FIG. 10(*b*), is defined as the angle θ2 formed at the crossing point between the extensions of the substantially flat surface portions of the inner wall. Therefore, even if the angle θ1 formed in the neighborhood of the corner portion hardly changes from the angle θ of the initial state, it will suffice if the θ2 changes.

In this embodiment, too, the same advantageous effects as with the first embodiment can be provided by using the liquid injection method of the present invention. Namely, the ink accommodatable amount per unit volume in the inside of the ink container casing when the ink expansion is taken into account, can be maximized. By using the liquid injection method of the present invention, the stabilized negative pressure can be produced from the beginning of use, without long using of the initial unstable region when the ambient temperature is substantially at the normal temperature. Additionally, the shock resistance is high during transportation of the container since the corner portions of the inner wall correspond to the corner portions of the outer wall without separation.

In the foregoing manufacturing method, the resin material has been described as being continuously supplied, but it is a possible alternative that same materials are used for the inner wall and the outer wall, and a material separable from the inner and outer walls is intermittently supplied into between the parison of the inner wall and the parison of the outer wall, thus making the ink accommodating portion (inner wall) is separable from the casing (outer wall). When the position of the ink supply port is deviated in the surface having the ink supply port, the distance between the parison and the mold is different at some portion, and therefore, distribution of the thickness may occur in the inner wall and the outer wall at the time of the blow molding, in some cases. In the case of the ink container shown in FIG. 8, the parison is supplied in the longitudinal direction of the container, and therefore, there is hardly any need of taking the thickness distribution in the longitudinal direction into the consideration. But, with respect to the corner portions defined by δ, ε, the thicknesses of the inner and outer walls are larger toward the supply port. As regards the maximum area surfaces, when they are cut along a plane parallel to the bottom surface, there is a thickness distribution. This is because the parison of a cylindrical shape is expanded to a prism having a parallelogram cross-section, and therefore, the thicknesses of the corner portions are smaller away from the mold surface. This is effective to positively determine the order of portions of collapses of the ink container since it is one of the factors to make the corner portion ε2 adjacent the side having the ink supplying portion less easily disengageable from the corresponding outer wall, as shown in FIGS. 9(*a*)–(*d*).

The present invention is not limited to the container of a quadratic prism shape having a parallelogram cross-section, although the description of the foregoing embodiments takes such and example. The present invention is applicable if the ink container has a structure by which the collapsing direction is regulated such that predetermined part of the inner wall corner portions corresponding to the outer wall is separated from the corresponding corner of the outer wall. In other words, the deformation starts at the maximum area surface or surfaces of the inner wall, and at one or ones of the corner portions of the inner wall, the inner wall are disengaged from the corner portion or portions of the outer wall, and at another one or ones of the corner portions of the inner wall are maintained at a predetermined positional relation relative to the corresponding corner portion or portions of the outer wall, so that order or way of deformation of various parts of the inner wall is regulated.

A small part the corner portion or corner portions of the inner wall and outer wall may be rounded (R). In this case, the angle is defined as an angle between the sides constituting the section by the outer wall, as shown in FIG. 10(*c*). Particularly when the portion at which the corner portion angle increases when the inner wall collapses by the consumption of the ink, is rounded (R) as shown FIG. 11(*a*), the final state is as shown in FIG. 11(*b*). When the rounding is not provided, as shown FIG. 11(*c*), the final state is as shown in FIG. 11(*d*). In the former case, the insufficiently collapsed portion at the final state is smaller. Additionally, the rounded portion is effective to promote the deformation of the ink container. For these reasons, the rounding is desirable.

In terms of the corner portion of the inner wall separating from the corresponding corner portion of the outer wall, it is located at a position opposing the maximum area side. If this is satisfied, the container is not limited to a polyhedron container, but it may be of bladder-like shape having a curved surface. With such a container having the curved surface configuration, it would be difficult to define the disengageable corner portion. In such a case, the portion where the curved surface is not continuous is defined as a bent portion, and the surface enclosed by the bent portions, is defined as a surface, and what is necessary is that bent portion of the inner wall disengaged from the corresponding bent portion of outer wall, is faced to the maximum area surface.

(Other embodiments)

Figure 12A:
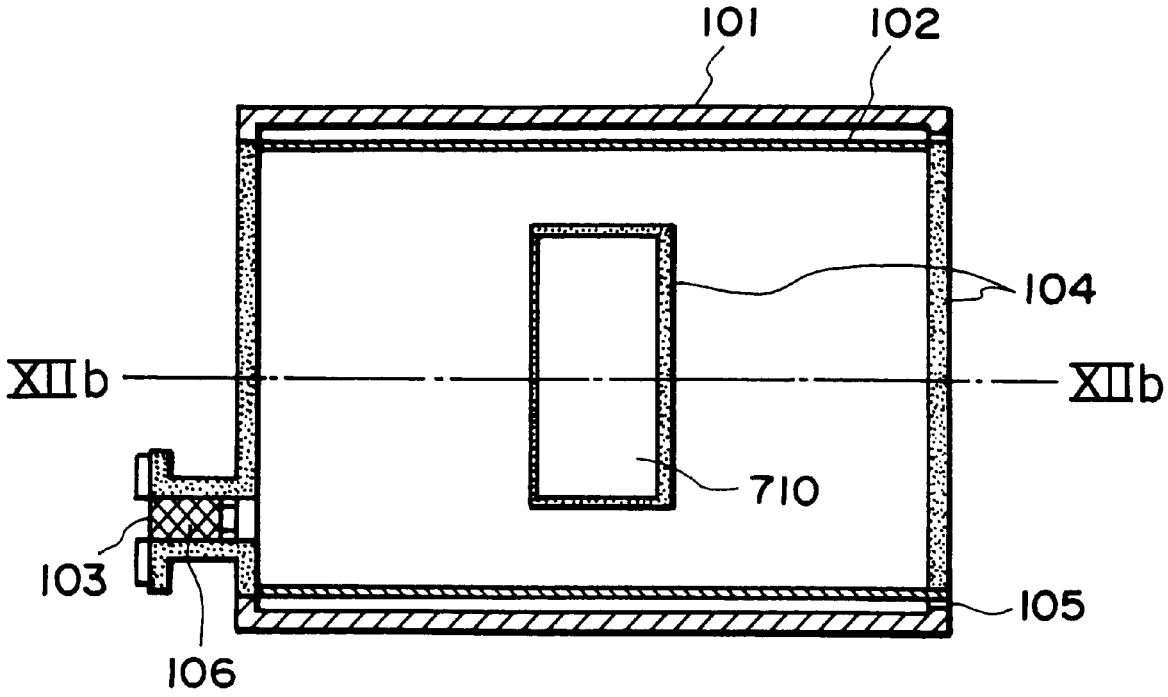
FIGS. 12(*a*) through 12(*b*) are schematic views showing another configuration of an ink container to which the injection method of the present invention is applicable.
Figure 12B:
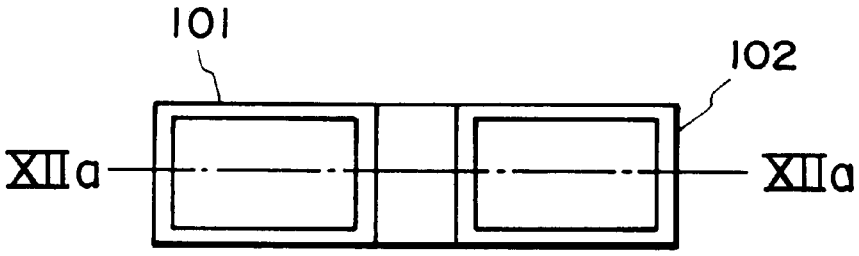
Figure 13A:
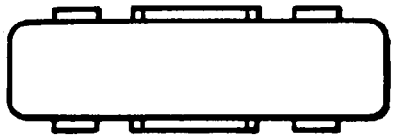
FIGS. 13(*a*) and 13(*e*) are schematic views showing a further configuration of an ink container to which the injection method of the present invention is applicable.
Figure 13B:
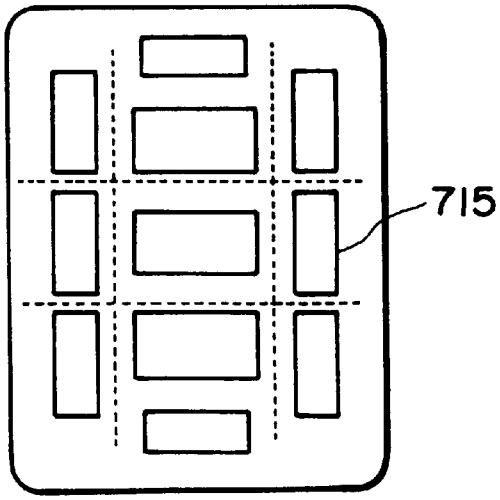
Figure 13C:
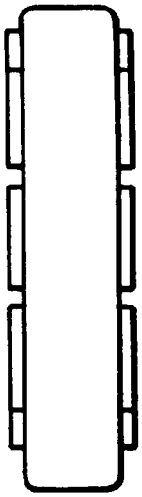
Figure 13D:
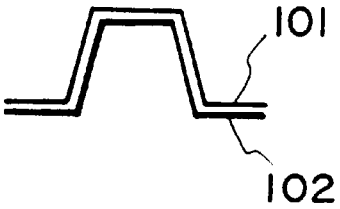
Figure 13E:
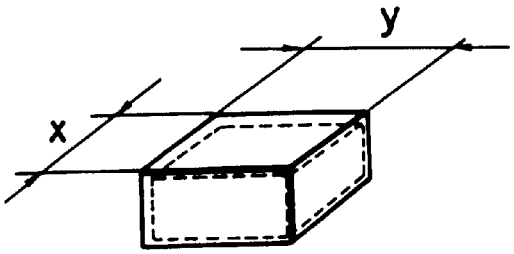

As regards the configurations of the container, modifications shown in FIGS. 12 and 13 are usable.

A liquid accommodating container shown in FIG. 12 is similar to that shown in FIG. 4, but the width of the pinch-off portion of the liquid accommodating container is provided substantially over the entire width of the side surface of the container, and a through-hole is formed through a central portion of the maximum area sides so that inner wall 102 and the outer wall 101 have a doughnut-like configuration. FIG. 12(*a*) corresponds to FIG. 4(*a*); FIG. 12(*b*) corresponds to the XIIB —XIIb section of FIG. 12(*a*) FIG. 12(*a*) corresponds to the XIIa—XIIa sectional view of FIG. 12(*b*). The liquid supply portion 103 side in the outer periphery of the outer wall 101, the opposite side therefrom, and the portion around the through-hole 710, are pinch-off portions, and the liquid containing portion is divided into two parts with the through-hole 710 therebetween.

The provision of the through-hole in the liquid container enhances the mechanical strength, and permits stabilized supply of the liquid from the inside. In addition, the circumference of the through-hole is a pinch-off portion, and the ambience is introduced there between the inner wall and the outer wall to further stabilize the liquid supply.

The provision of the through-hole is effective to reinforce the maximum area side when the liquid containing portion contains the liquid to its maximum, and therefore, the outer surface of the inner wall and the inner surface of the outer wall are contacted to each other; and when the liquid is consumed, the provision of the through-hole is effective to maintain the position of the liquid containing portion against the external shock, since the inner wall is supported by the outer wall around the through-hole.

A liquid accommodating container shown in FIGS. 13(*a*)–(*e*) is similar to that shown in FIG. 4; in FIG. 13, FIG. 13(*a*) FIG. 13(*b*) and FIG. 13(*c*) are respectively and end view, top plan view and side view of the modified container.

The fundamental structure of this embodiment is the same as that of FIG. 4 embodiment. But in FIG. 13, the supply port is omitted for the better explanation of a projection which is a feature of this modification.

In the modified example, a rib 715 is formed on a maximum area side of the liquid accommodating container 100. Each rib 1601, 1602 is in the form of an elongated projection extending in the vertical direction (Figure) of the maximum area side. A similar rib is formed also on the opposing surface (unshown).

In this modified example, the rib 715 is provided by a plurality of columnar projections having different sizes, which decreases toward the marginal portions from the center of the maximum area side.

With such a structure, the resistance against the collapsing is stronger at the center portion of the maximum area side. By arranging a plurality of small projections in the marginal portion, the strength, against the collapse, along the line connecting the outer periphery portion is uniform, so that collapsing way can be controlled.

The configuration of the projection, may be trapezoidal as shown in FIG. 13(*d*). The configuration of a column-like projection in the modified examples, is as shown in FIG. 13(*e*). By selecting the aspect ratio (x:y), the strength against the collapse can be adjusted.

In the foregoing embodiments, the ink discharge permission member is mounted to the ink accommodating portion when the ink is supplied to the ink accommodating portion. A further description will be made as to an embodiment which is applicable to all of the foregoing embodiments.

At the time when the discharged amount of the ink is small, the negative pressure property of the ink container may be unstable. If this is to an unsatisfactory extent, a small quantity of the air having a temperature higher than the normal temperature may be permitted to enter the liquid containing portion in the process of mounting the small amount, and then, the container may be hermetically sealed. The temperature is such air is preferably equivalent to the temperature of the liquid injected, and it preferably contains the vapor of the liquid injected.

The volume of the air thus introduced reduces more than the liquid accommodated therein, when the temperature returns to the normal temperature. Therefore, the negative pressure is stabilized from the beginning of use, assuredly avoiding the unstable region of the negative pressure property shown in FIG. 6(*a*). Although the usage efficiency of the ink container is slightly lower than the foregoing embodiments, the ink supply to a recording head is stabilized, and it is usable even in such a case that tolerance of the negative pressure change of the recording head is severe. In the case of allowing the air to enter the ink accommodating portion, it is desirable to provide bubble removing means such as a filter in the liquid supply path between the liquid discharge portion and the recording head as well as disposing the liquid discharge portion in the bottom surface of the liquid accommodating container to prevent the introduction of the air into the recording head. Practically, the quantity of the air entering the container is preferably not more than 10%, further preferably not less than 0.5% and not more than 5%, since if it is too large the ink accommodation efficiency lowers correspondingly.

As described in the foregoing, according to the present invention, the minimum and proper room can be provided for the liquid containing portion by the degree corresponding to the expansion of the liquid due to temperature rise. Therefore, the liquid is prevented from leaking out even when the ambient temperature varies, with high accommodation efficiency. This invention is particularly effective when the liquid containing amount is large, since the increase amount of the ink accommodation capacity provided by the improvement of the accommodation efficiency.

While the invention has been described with reference to the structures disclosed herein, it is not confined to the details set forth and this application is intended to cover such modifications or changes as may come within the purposes of the improvements or the scope of the following claims.

What is claimed is:

1. A liquid injection method for a liquid container adapted for use at an expected normal temperature for ink jet recording, said liquid container including a flexible liquid containing portion for containing liquid in substantially hermetically sealed state, a casing for separably covering the liquid containing portion and having an inside configuration equivalent or similar to an outer configuration of the liquid containing portion, and a liquid discharging portion for permitting the liquid to be discharged to outside, said method comprising the steps of:

filling the liquid having a temperature higher than the normal temperature into the liquid containing portion from outside of said liquid containing portion;

substantially hermetically sealing the liquid discharging portion with a liquid discharge permission member removable to permit the liquid to discharge in use; and generating a negative pressure in said liquid container by lowering a temperature inside said liquid container toward the normal temperature.

2. A method according to claim 1, wherein the temperature is not more than 60° C.

3. A method according to claim 1, wherein the casing has a substantial air vent, and has a prism-like configuration, wherein a corner portion of the liquid container defined by three sides of the prism configuration corresponds to a corner portion of the casing defined by three sides of the prism configuration, wherein a thickness of a wall constituting the liquid containing portion is thinner adjacent the corner portion than a central portion of sides of the prism-like configuration.

4. A method according to claim 1, wherein the casing has a substantial air vent, and has a prism-like configuration, wherein corner portions of the liquid container each defined by two sides of the prism configuration corresponds to corner portions of the casing defined by two sides of the prism configuration, wherein the corner portions of the liquid containing portion include a first corner portion which separates from a corresponding one of the corner portions of the casing with discharge of the liquid out of the liquid container, and a second corner portion which substantially maintains a positional relation relative to the casing.

5. A method according to claim 1, wherein the liquid containing portion of the liquid container has a bent portion at a position opposing to a maximum area side of the liquid container, the bent portion separating from a wall of the casing with discharging of the liquid out of the liquid containing portion.

6. A method according to claim 1, wherein the liquid discharge permission member is of rubber member which is welded to the liquid discharging portion by ultrasonic welding.

7. A method according to claim 1, wherein said sealing step is carried out with the liquid containing portion containing air having a temperature higher than the normal temperature.

8. A liquid container filled with the liquid through a method as defined in any of claims 1 to 7.

9. A manufacturing method for a liquid container adapted for use at an expected normal temperature, wherein said liquid container includes:

an outer wall having a polygonal cross-section;

an inner wall having an outer surface equivalent to an inside surface of the outer wall and having a liquid accommodating portion capable of containing liquid therein; and a liquid supply portion for supplying the liquid out of the liquid accommodating portion;

said method comprising the steps of:

providing a mold corresponding to an outer shape of the liquid container;

providing a substantially cylindrical shaped first parison for the outer wall, said first parison having a diameter smaller than that of the mold;

providing a substantially cylindrical shaped second parison for the inner wall;

expanding the first and second parisons by injecting air so that the first parison extends along the mold, so that inner wall and the outer wall are separable from each other, and so that a space defined by the inner wall and a space defined by the outer wall are similar in configuration to each other;

filling the liquid having a temperature higher than the normal temperature into a space defined by the inner wall from outside of said liquid containing portion; and generating a negative pressure in said liquid container by lowering a temperature inside said liquid container toward the normal temperature.

* * * * *

UNITED STATES PATENT AND TRADEMARK OFFICE

CERTIFICATE OF CORRECTION

PATENT NO. : 6,328,437 B1
DATED : December 11, 2001
INVENTOR(S) : Hiroaki Mihara et al.

It is certified that error appears in the above-identified patent and that said Letters Patent is hereby corrected as shown below:

Title page,
Item [56], References Cited, FOREIGN PATENT DOCUMENTS,
"56067269" should read -- 56-67269 --.
"06226993 8/1994 (JP)." should be deleted.

Column 2,
Line 28, "has" should read -- which has --.

Column 6,
Line 21, "in FIG. 4" should be deleted, and "indirectly" should read -- indirectly in --.

Column 7,
Line 16, "(a2)) Here," should read -- a(2)). ¶ Here, --;
Line 54, "(FIGS. 5(b1), (b2))." should read -- (FIGS. 5(b1) and (b2)). --; and
Line 56, "(FIGS. 5(c1), (c2))," should read -- (FIGS. 5(c1) and (c2)), --.

Column 12,
Line 56, "shows" should read -- show --.

Column 17,
Line 53, "12(a)" (first occurrence) should read -- 12(a). --.

Column 18,
Line 10, "13(a)" should read -- 13(a), --; and "and" (second occurrence) should read -- an --; and
Line 49, "is such" should read -- in such --.

Signed and Sealed this

Twenty-second Day of October, 2002

*Attest:*

*Attesting Officer*

JAMES E. ROGAN
*Director of the United States Patent and Trademark Office*